United States Patent [19]

Venot

[11] 4,206,588

[45] Jun. 10, 1980

[54] MACHINE FOR THROWING AND TWISTING YARNS

[75] Inventor: Jean Venot, Roanne, France

[73] Assignee: ASA S.A., Roanne, France

[21] Appl. No.: 7,967

[22] Filed: Jan. 31, 1979

[30] Foreign Application Priority Data

Feb. 15, 1978 [FR] France ..... 78 04984

[51] Int. Cl.[2] ..... D01H 1/24; D01H 1/28; D01H 13/14

[52] U.S. Cl. ..... 57/80; 57/84; 57/88

[58] Field of Search ..... 57/61, 78, 80, 81, 82, 57/83, 84, 88, 89, 90, 264

[56] References Cited

U.S. PATENT DOCUMENTS

| | | | |
|---|---|---|---|
| 897,129 | 8/1908 | Nightingale | 57/82 X |
| 2,576,936 | 12/1951 | Heffelfinger | 57/80 |
| 2,975,584 | 3/1961 | Makant et al. | 57/88 |
| 3,003,303 | 10/1961 | Wright | 57/78 |
| 3,501,102 | 3/1970 | Long . | |
| 3,846,965 | 11/1974 | Matsumura et al. | 57/80 X |

FOREIGN PATENT DOCUMENTS

| | | |
|---|---|---|
| 1920449 | 4/1968 | Fed. Rep. of Germany . |
| 1062599 | 4/1954 | France . |
| 1454791 | 10/1966 | France . |
| 788242 | 12/1957 | United Kingdom . |

*Primary Examiner*—Donald Watkins
*Attorney, Agent, or Firm*—Arnold, White & Durkee

[57] ABSTRACT

A yarn throwing and twisting machine has at each of a number of working positions two or more throwing spindles, a twisting spindle, a manually disengageable yarn feeder, and yarn break detectors. Pneumatic jacks are provided to disengage the spindles and feeder upon yarn breakage and are controlled by air supplied through a solenoid valve responsive to the yarn break detectors and by a manually operable valve between the throwing and twisting spindles. The solenoid valve is closed, however, upon manually disengagement of the yarn feeder for the purpose of allowing starting up at an individual working position after yarn breakage.

4 Claims, 3 Drawing Figures

MACHINE FOR THROWING AND TWISTING YARNS

The present invention relates to a machine for throwing and twisting yarns.

Machines which, in a single operation, throw yarns and simultaneously twist two or more of the thrown yarns together are well-known and are usually referred to as "thrower-twister".

One example of such a machine is described in French Pat. No. 1,062,599, in which the thrower-twister has a central framework, on either side of which are arranged an equal number of working positions, with control means (motors, and raising and lowering devices) being grouped together in two heads located at each end of the framework.

Each working position has, for throwing, at least two single-twist or double-twist spindles, for example two ring and traveller spindles and for twisting, a further ring and traveller spindle.

In general practice and as described in British Pat. No. 788,242, the throwing spindles are located in a lower zone of the machine and the twisting spindle in an upper zone, the spindles being so arranged that they are accessible to an operator in order to facilitate the replacement of full bobbins by empty carriers, or to facilitate any other operation.

In this type of machine, a yarn feed device is located between the throwing spindles and the twisting spindle, this feeder acting as a combining element when the separately thrown yarns are twisted together, and yarn break detectors are located upstream and downstream of this feeder.

The drive for the throwing and twisting spindles is provided by endless belts driving pulleys which are firmly fixed to the axles of the spindles.

There are several rows of throwing spindles, with groups of spindles being driven by one belt, preferably controlled by an independent motor unit, and optionally with a reversing mechanism.

To achieve good functioning of the machine, there are at each working position means to cause the simultaneous engagement of the throwing and twisting spindles and of the feeder associated therewith.

In the arrangement described in the abovementioned French Pat. No. 1,062,599, which is still used and produced (for example on type ARU spinning frames of Messrs. A.R.C.T.), this simultaneous engagement is achieved by means of a pedal connected to a rod which is connected with the abovementioned spindles and feeder. The rod is subjected to the compression force of a spring to be locked in an engaged position, while if a yarn break occurs, the yarn break detectors cause unlocking of the said rod and hence the disengagement of the spindles and feeder. Equally, if it is desired to change the yarn bobbins, the various positions are successively disengaged and re-engaged by operating the control pedal.

This machinery is satisfactory but it can be appreciated that since all the controls are effected by means of rod linkages, it is very difficult to achieve great precision in these transmissions and in particular to achieve perfect synchronisation in the engagement and disengagement of the various parts. Also, the complete unit is relatively complex and difficult to regulate and to maintain, and is relatively expensive.

There has also been proposed, in French Pat. No. 1,454,791, a spindle in which the means of engagement and of disengagement can be controlled by pneumatic or hydraulic means. Such an embodiment is however not applicable to the machines of the abovementioned type which permit the continuous throwing and twisting of yarns.

According to the present invention there is provided a yarn throwing and twisting machine having a number of working positions, there being at each working position at least two throwing spindles, a twisting spindle, a manually engageable and disengageable yarn feeder between the throwing spindles and the twisting spindle, yarn break detectors on each side of the yarn feeder, and respective pneumatic jacks associated with the throwing spindles, twisting spindle and the yarn feeder, for causing engagement and disengagement thereof, the pneumatic jacks being interconnected by a common pipeline connectable to a source of compressed air via a solenoid valve, the opening and closing of which is controlled by the yarn break detectors, and a manually operable valve in the pipeline between the jacks associated with the throwing spindles and the jack associated with the twisting spindle.

A machine according to the invention reduces the abovementioned disadvantages and in particular ensures precise and sure braking or disengagement of the various members of the machine, as well as easy restarting, both during a complete change of the bobbins and during start-up at a single position in the case of a yarn break. Furthermore, the machine according to the invention is simple, and economical to produce and to maintain.

Generally, the spindles at each working position will be driven by an endless belt acting by tangential contact with a pulley firmly fixed to the axle of each spindles.

Conventional pneumatic jacks can be used, preferably jacks of the single-action piston type, and the solenoid valve can also be conventional solenoid valve, for example of the three-way type.

Furthermore, the valve located in the part of the pipeline between the twisting spindle to the throwing spindles can also be of a conventional valve, and it is preferably controlled by means of a foot-operated lever or pedal.

When the respective pneumatic jacks are operated, they disengage the feeder and brake the throwing and twisting spindles.

Advantageously the feeders each consist of two rollers separated from one another and drivable by means of a drive gearwheel. The two rollers can be mounted on a pivoting case, the movement of which can be brought about either directly by the associated pneumatic jacks or manually by means of a handle. Furthermore, return means such as a spring will preferably normally act so as to keep gearwheels associated with the rollers in contact with the drive gearwheel. The manual control handle for the disengagement of the feeder, when actuated, controls means causing the solenoid valve to close despite any yarn breakage signal received. Such means advantageously include a microswitch.

The yarn break detectors can be conventional sensors connected by a suitable electric circuit to the solenoid valve through which the compressed air enters the pipeline. Preferably, the yarn sensors are of the rocking lever type.

The invention will be more clearly understood from the following description which is given by way of example only with reference to the accompanying drawings in which.

Figure 1:
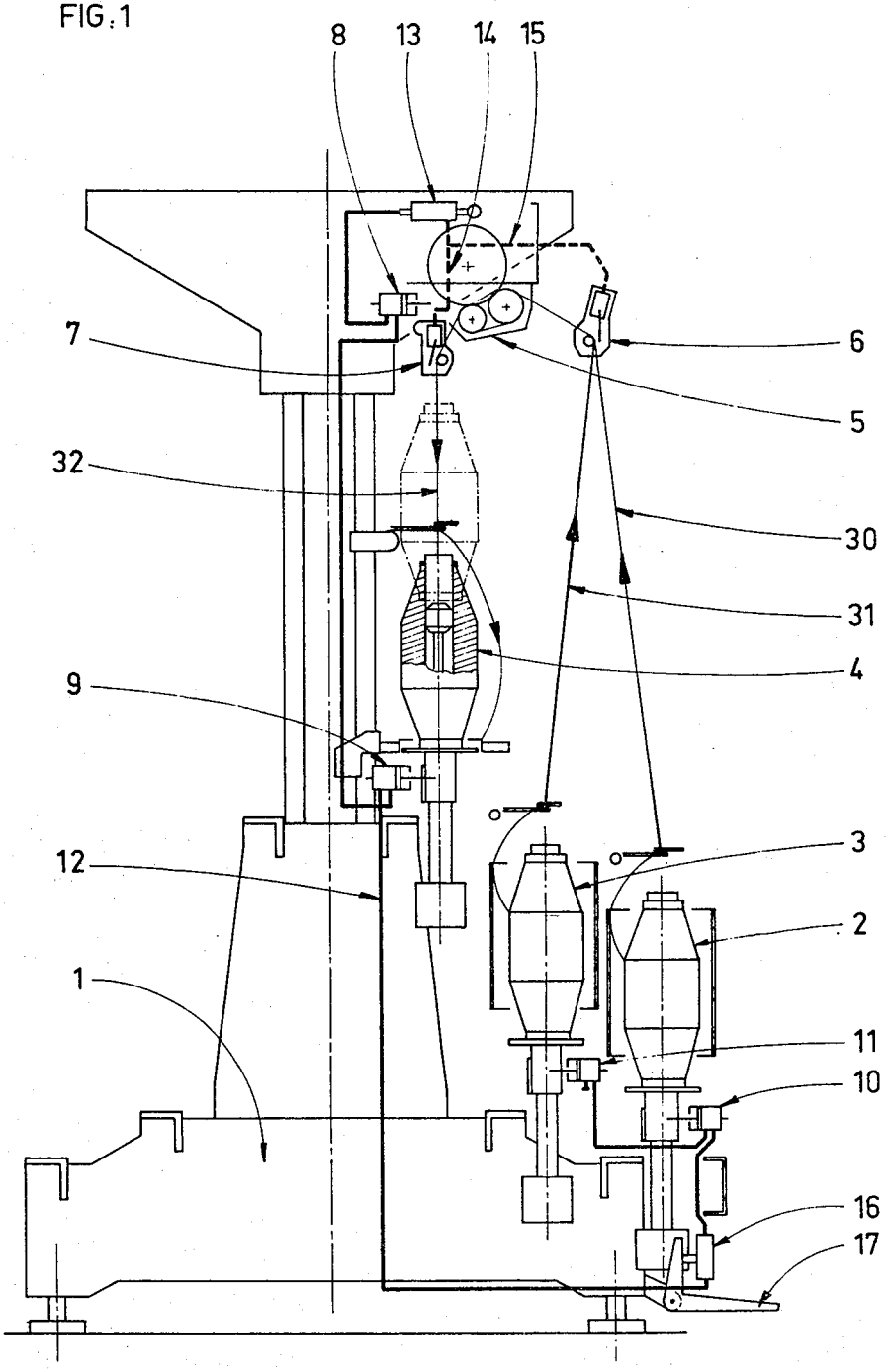
FIG. 1 is a schematic side view of a thrower-twister constructed in accordance with the invention.
Figure 2:
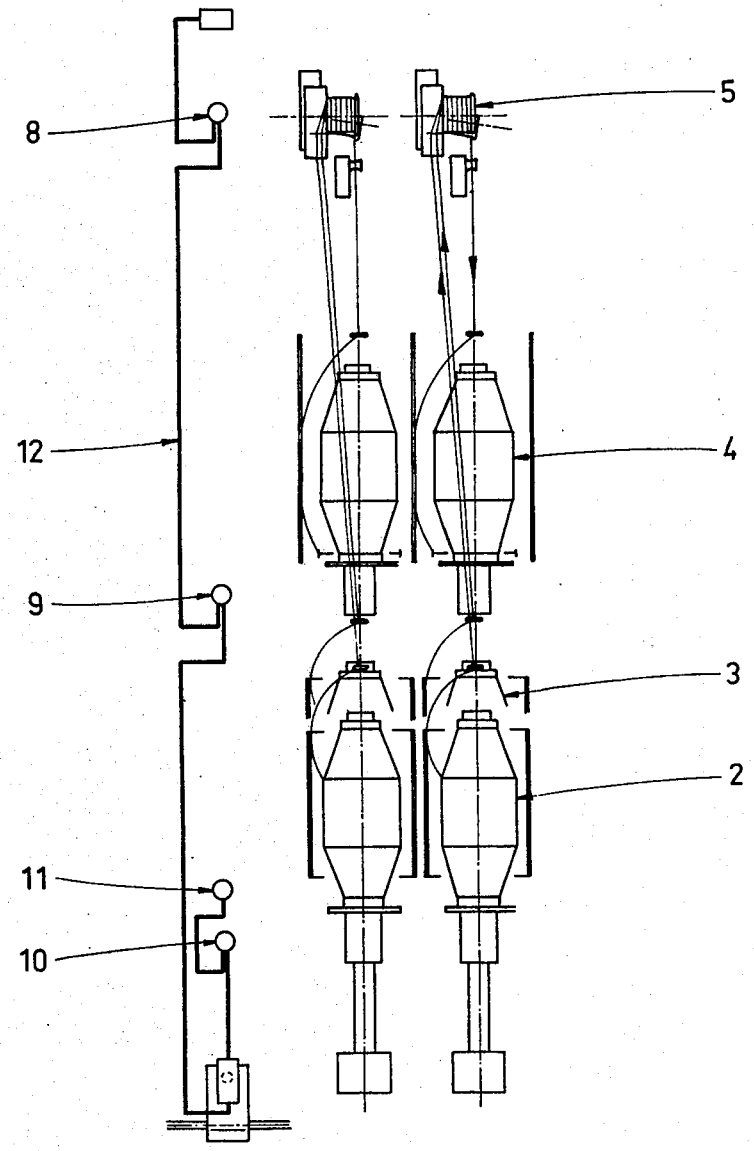
FIG. 2 is a front view which shows two working positions of a thrower-twister according to the invention, as well as the control circuit of the pneumatic jacks of a third working position.

In FIG. 1, only one working position has been shown, but it is clear that an identical second working position is located symmetrically thereto relative to the axis of the framework 1 of the spinning frame, and that these working positions are both in rows of identical working positions extending along the two sides of the frame. According to the invention, each working position mounted on the common central framework 1 comprises at least two throwing spindles such as 2 and 3 located in a lower zone of the machine and a twisting spindle 4 located in an upper zone. The spindles 2,3 and 4 are as shown conventional simple twist spindles of the ring and traveller type. These spindles are driven in a known manner by means of endless belts, the throwing spindles 2 and 3 preferably being driven by means of a single motor which controls two separate belts acting on pulleys fixed to the axles of these spindles, whilst the twisting spindles 4 are driven by means of a second motor.

The motors, as well as conventional raising and lowering components, are located at the ends of the framework of the spinning frame. Furthermore, tensioning devices are provided for the belts to be held in contact with the drive pulleys, but these are well-known components.

Each working position also comprises, a feeder 5 located between the throwing spindles 2, and the twisting spindle 4, preferably in the upper part of the frame, and thread-break detectors 6, 7 located on either side of the feeder 5.

At each working position there are means for disengaging and engaging the spindles and the feeder, such means including pneumatic jacks, 8,9,10,11, such as piston jacks. These pneumatic jacks are connected to one another by a common pipeline 12, which at its upstream end has a solenoid valve 13, which allows the said pipeline 12 to be fed with compressed air when the valve is open.

The opening and closing of the solenoid valve 13 is controlled directly by means of the thread break detectors 6 or 7, by employing suitable electrical circuits 14,15.

Furthermore, the common pipeline 12 is provided with a valve 16, the opening and closing of which is controlled directly by the operator, this valve being located in a section of the pipeline between the twisting spindle 4 and the throwing spindles 2 and 3, that is to say between the pneumatic jack 9 and the pneumatic jack 10. In the present case, this valve 16 is located in the lower part of the frame and can be actuated by means of a lever 17, in the form of a pedal to be controlled by the operator's foot.

Figure 3:
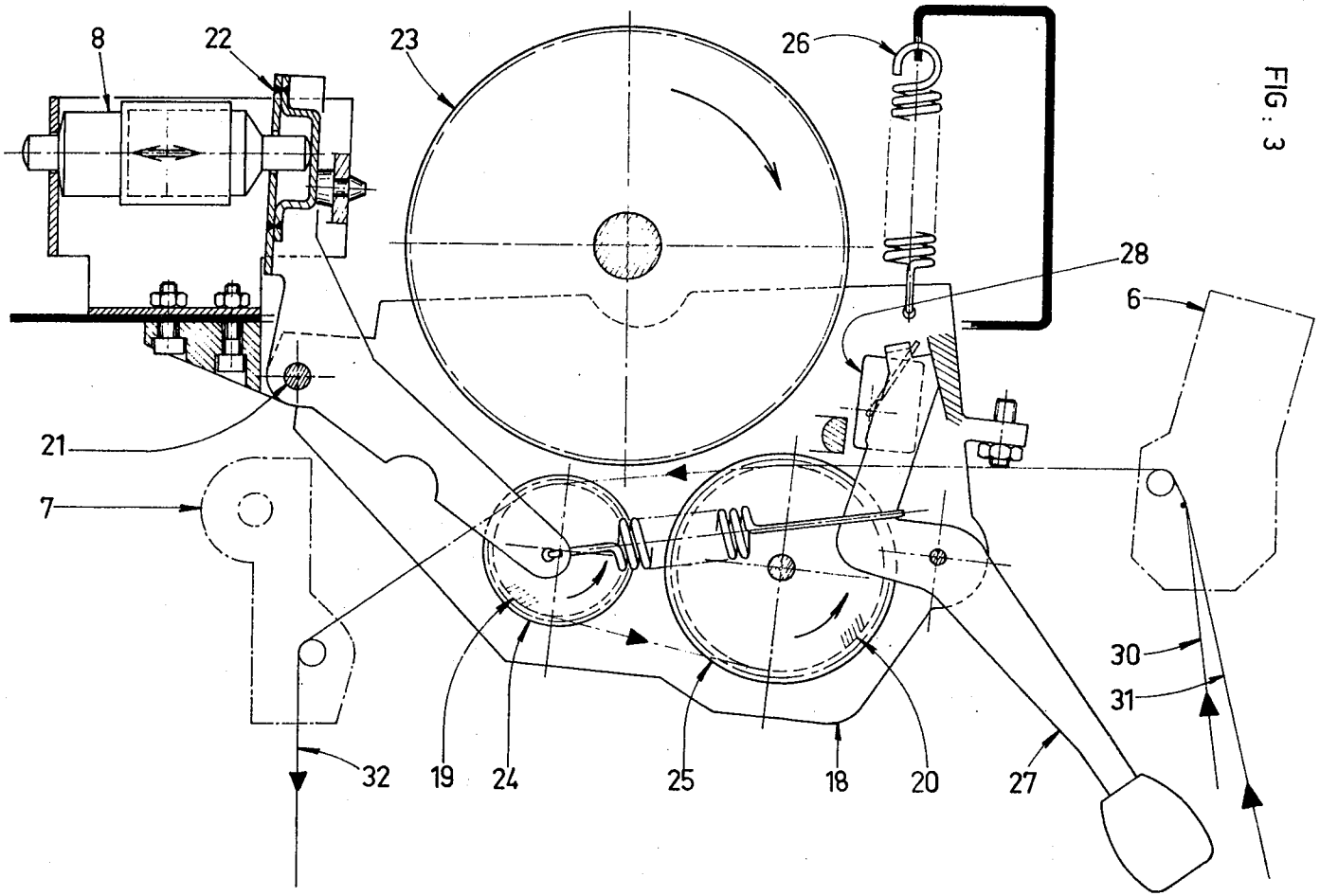
FIG. 3 is a schematic view which illustrates a particular feeder for use in a machine of the invention.

Finally, the yarn feed device 5, which is illustrated more especially in FIG. 3, essentially consists of a case 18, which supports two rollers 19, 20 and which is mounted so as to pivot about an axis 21. The pivoting of this case 18 can be controlled either by means of the jack 8, which acts on an arm 22 and tends to cause the case 18 to pivot when it moves, or manually by means of a handle 27. The rollers 19, 20 can be driven, the case being upwards as shown, by means of a drive gearwheel 23 in engagement with gearwheels 24, 25 located at the ends of the rollers 19, 20. A return sping 26 normally holds the case upwards to bring about such engagement. When the handle 27 is depressed to disengage the feeder, it affects a micro-switch 28 connected by a suitable electric circuit to the solenoid valve 13 and intended to cancel this solenoid valve and cause it to close and to thus stop the action of the pneumatic jacks, particularly jack 8.

The feeder 5 serves to draw off and combine two component thrown yarns 30, 31, from the throwing spindles 2 and 3, these yarns being combined to form a single assembled yarn 32 at the feeder outlet.

The operation of the device described is as follows.

When carrying out a general setting-up operation, that is to say when it is desired to change all the bobbins of the machine, the frame is stopped completely by stopping the motors.

The motors thus being stopped, the thread break detectors are also cancelled, that is to say they are no longer supplied with current and consequently the solenoid valves 13 are inevitably kept shut. The pneumatic jacks 8, 9,10 and 11 are thus out of action and all the components, that is to say the feeder 5 and the spindles 2,3,4, are kept engaged.

After having re-fitted the frame with bobbins, the threads are, at each position, passed manually over the thread break detectors 6, through the feeder 5, which is disengaged manually by pressing the handle 27, and then through the thread break detector 7 to the twisting spindle 4. All the positions having thus been refitted, the motors are restarted and all the positions start up simultaneously. The electric circuit of the thread break detectors is then brought into action to open the associated valves 13 in the event of thread breakage.

If a break occurs at one of the positions, one of the thread break detectors 6 or 7 causes the solenoid valve 13 to open and hence the jacks 8 and 9 to be placed under pressure, which jacks disengage the feeder 5 and brake the twisting spindle 4. The valve 16, however, remains closed so that the throwing spindles 2, 3 continue to turn. These spindles are now braked by the operator, who presses the pedal 17, which opens the valve 16 to allow the jacks 10 and 11 to come into action. The threads coming from the throwing spindles 2 and 3 are again passed over the thread break detector 6, through the disengaged feeder 5, and through the thread break detector 7 to the twisting spindle 4, which of course is braked.

On restarting, the yarn feeder 5 is manually kept disengaged for a period by pressing the control lever 27. Depression of this lever overrides the yarn breakage signals from the detectors 6 and 7 and allows the solenoid valve 13 to be closed so that the twisting spindle 4 and the throwing spindles 2 and 3 are started. When the twist has extended back and the yarn is under tension, the lever 27 which has kept the feeder disengaged is released, so that the feeder now returns to its engaged position under the action of the return spring 26. Thereafter, solenoid valve 13 is again responsive to any yarn break signals from detectors 6 and 7.

The preceding description clearly shows the advantages provided by the invention and especially the great simplicity and above all the ease with which this thrower-twister can be used.

It is obvious that modifications can be made to the device described above without however going outside the scope of the invention. Thus, the invention is equally applicable to thrower-twisters in which either the throwing spindles or the twisting spindles or all these spindles consist of double-twist spindles instead of consisting of simple twist spindles.

I claim:

1. A yarn throwing and twisting machine comprising a number of working positions, there being at each working position at least two throwing spindles, a twisting spindle, a manually engageable and disengageable yarn feeder between said throwing spindles and said twisting spindle, yarn break detectors upstream and downstream of said yarn feeder, and respective pneumatic jacks associated with said throwing spindles, said twisting spindle and said yarn feeder, for causing engagement and disengagement thereof, a common pipeline connecting said pneumatic jacks, a solenoid valve for connecting said pipeline to a source of compressed air, opening and closing of said solenoid valve being controlled by said yarn break detectors, and a manually operable valve in said pipeline between the jacks associated with the throwing spindles and the jack associated with the twisting spindle.

2. A machine as claimed in claim 1, wherein said throwing spindles are located in a lower zone of the machine, said twisting spindles are located in an upper zone of the machine and said yarn feeders are located in a top part of the machine.

3. A machine as claimed in claim 1, wherein said yarn feeders each comprise two rollers separated from one another, a pivoting case on which said two rollers are mounted and a drive gearwheel to drive said rollers in one position of said case, said case having a handle by which it can manually be pivoted and being pivotable by the associated said hydraulic jack.

4. A machine as claimed in claim 1 including circuit means including a microswitch to maintain said solenoid valve closed upon manual disengagement of said yarn feeder.

* * * * *